United States Patent [19]

Gilsenan

[11] 4,256,129

[45] Mar. 17, 1981

[54] TENT ROOF STRUCTURE

[76] Inventor: John T. Gilsenan, Broxmore, Cliftonville, Dorking, Surrey, England

[21] Appl. No.: 30,684

[22] Filed: Apr. 16, 1979

[30] Foreign Application Priority Data

Apr. 21, 1978 [GB] United Kingdom ..... 15806/78

[51] Int. Cl.[3] ..... A45F 1/16; E04B 1/347

[52] U.S. Cl. ..... 135/4 R

[58] Field of Search ..... 135/4 R

[56] References Cited

U.S. PATENT DOCUMENTS

| | | | |
|---|---|---|---|
| 2,710,012 | 6/1955 | Powers et al. | 135/4 R |
| 2,948,287 | 8/1960 | Rupert | 135/4 R |
| 3,000,386 | 9/1961 | Schulze et al. | 135/4 R |
| 3,710,806 | 1/1973 | Kelly et al. | 135/4 R |
| 3,888,056 | 6/1975 | Kelly et al. | 135/4 R X |

FOREIGN PATENT DOCUMENTS

| | | | |
|---|---|---|---|
| 626040 | 10/1961 | Italy | 135/4 R |
| 58338 | 10/1937 | Norway | 135/4 R |

*Primary Examiner*—J. Karl Bell

*Attorney, Agent, or Firm*—Karl W. Flocks

[57] ABSTRACT

For a readily erectible tent, a roof structure is provided in which all the elements are articulated and so arranged that the structure is capable of adopting an erect position to support canvas and a collapsed position in which it is transportable. The erectible feature is facilitated by a central carrier to which articulated rafter struts are pivotally connnected. The carrier has first and second carrier plates arranged for mutual axial displacement towards each other from the collapsed position in which the rafter struts are folded to the erect position in which the rafter struts are extended, movement of the plates towards each other effecting extension of the rafter struts. Supporting legs—side wall members—may also be articulated to the roof structure to provide a completely articulated unitary frame.

8 Claims, 7 Drawing Figures

FIG. 2
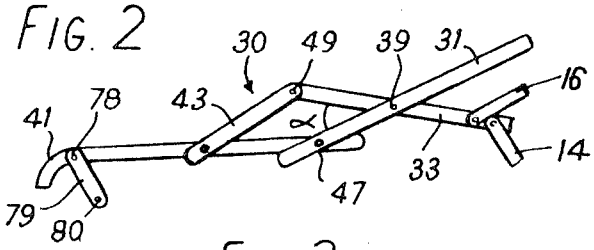
FIG. 3
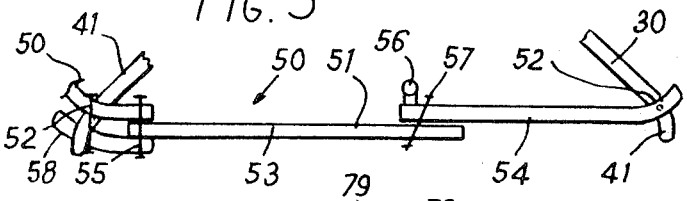
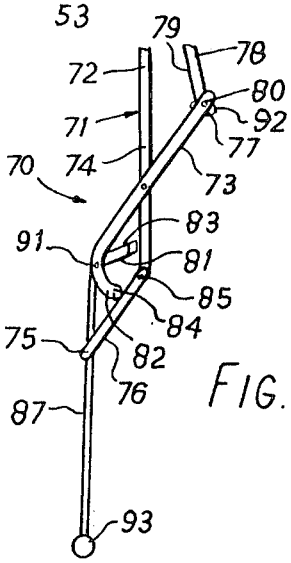
FIG. 4

TENT ROOF STRUCTURE

A frame structure for a tent or like portable structure comprising an erectible frame with a flexible covering, and the term "tent frame structure" is to be construed accordingly.

Tents are usually erected by assembling poles or support members, placing a canvas covering on the poles, and supporting the structure with guy ropes. This procedure can be time consuming and difficult in adverse weather conditions.

In an endeavour to provide a tent which is more readily erected, a tent is available which is permanently mounted on a trailer and which has a frame of what is known as the pram hood construction, i.e. a series of frame inverted U-shaped members pivotaly connected at common pivots. The frame members in the collapsed condition of the tent lie substantially parallel within the trailer and in the erect condition extend at angularly spaced intervals about the pivots to stretch and to support the frame covering. However, this construction is essentially a trailer supported construction.

This invention seeks to provide a roof structure for a tent which is a unitary structure and is readily erectible and collapsible and also portable. In an embodiment the roof structure forms part of a unitary frame structure. Such a roof structure preferably avoids a central roof pillar which in bell-tents inhibits maximum utility of tent space.

According to one aspect of the present invention there is provided; a tent frame structure having a roof structure comprising a plurality of collapsible roof struts each having a first strut member and a second strut member, said first and second strut members being pivotally connected to a respective one of first and second central carrier members, said first and second central carrier members being arranged for relative displacement towards each other to a first position in which said first and second central carrier members are axially aligned by axial coupling means and in which first position the collapsible roof struts extend outwardly from said first and second central carrier members from a second position in which said first and second central carrier members are axially displaced from one another to enable said struts to adopt a folded attitude in which the first and second strut members extend substantially axially of the first and second carrier members.

In the preferred embodiments the first and second strut members are articulated members foldable about pivot points intermediate their longitudinal dimension.

A preferred embodiment of this roof structure is provided in which the first central carrier member comprises a plate-like member having a central aperture, said plate-like member having a plurality of angularly spaced compartments each defining first and second abutments to limit the movement of a respective first strut member beyond the position occupied by that member in said first and second positions of the carrier members.

In the same embodiment it is preferred that the second central carrier member comprises a plate-like member having a central aperture, said plate-like member having a plurality of angularly spaced compartments each defining first and second abutments to limit the movement of a respective second strut member beyond the position occupied by that member in said first and second positions of the carrier members.

For increased rotational stability of the structure during displacement between said first and second positions, the second central carrier member comprises an additional plate-like member having a central aperture, and further plate-like member having a plurality of angularly spaced compartments each defining first and second abutments to limit the movement of a respective second strut member beyond the position occupied by that member in said first and second positions of the carrier members, wherein each second strut member is linked by a first link to the plate-like member of the second central carrier and a second link to the further plate-like member of the second central carrier, whereby said first and second links assist in maintaining rotational stability of the struts about the central carrier members.

For ensuring axial stability of the structure during displacement the axial coupling means comprises an elongate member fixedly connected to one of said first and second central carrier members and aligned with the central aperture of the plate-like member thereof, said elongate member in said first position extending through the plate-like member or members of the other of said first and second central carrier members and retained by releasable fastening means such as a pin and socket fastening.

It is preferred to provide additional roof covering support wherein one of said first and second strut members is pivotally linked to a peripheral roof member, said peripheral roof member being articulated at an intermediate portion thereof to fold in response to folding of the respective strut, also said peripheral roof member being pivotally connected to another peripheral roof member.

With this structure to facilitate the erection of the frame the pivot axis of the connection between the peripheral member and the strut is aligned with the direction of axial movement of said coupling means, the pivotal axis of the articulated connection at the intermediate portion of the peripheral roof member being inclined inwardly of the roof structure in its first position relative to said first mentioned pivotal axis.

Advantageously the preferred embodiment has an arrangement in which an angle of inclination between said pivotal axes of 30° facilitates the folding of said peripheral members simultaneously with the folding of said struts in a hexagonal roof structure.

It has been found in practice that advantageously the outer end of the articulated member connected to the peripheral members is arcuate to facilitate the connection thereto of a respective side wall member.

In a complete tent frame structure there is provided a side wall member for connection at the junction of each strut and peripheral roof member.

It is a feature of the preferred embodiments to provide that each side wall member is pivotally connected to a respective roof strut.

A preferred embodiment is provided in which each side wall member comprises first and second articulated wall struts, the first wall strut having a first part adapted at one end for rigid connection to the end of a respective said one strut member and a second part pivotally connected to the second wall strut, the second wall strut having a first part coupled by pivotal connection to the same roof strut by a link pivotally connected with said one strut member and with the pivotal connection.

In this embodiment it is an advantageous feature to ensure the articulated ends of the first and second parts of the second wall strut are arcuate and provide stops to abut first and second parts of the first wall strut whereby, in the erect second position of the roof structure with the side wall members also erect, the side wall member is stablized with respect of outward movement of the articulation of the second wall strut.

In the preferred embodiment the peripheral roof members define a regular geometric shape, e.g. a rectangle, pentagon, hexagon, octagon. Consequently, the compartments on the plate-like members are regularly angularly spaced.

An embodiment of the invention will now be described by way of example only, with reference to the accompanying drawing in which:

FIG. 2 shows in elevation, roof strut for connection to the central carrier unit of FIG. 1;

FIG. 3 shows in elevation, a peripheral roof member which extends between pairs of roof struts shown in FIG. 2;

FIG. 4 shows a side wall member for connection to the junction between the roof strut and roof member of FIG. 2;

Figure 7:
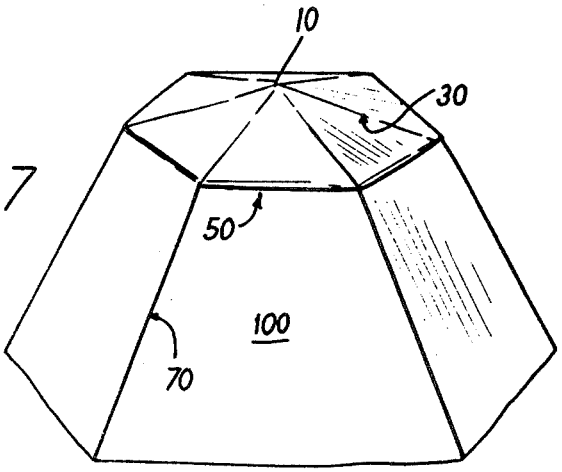
FIG. 7 is a sketch of a tent for illustrating the geometric relationships of the parts of the tent structure of FIGS. 1 to 4 when assembled and erected.

A frame structure for a tent, such as sketched in FIG. 7, comprises structural parts illustrated in FIGS. 1 to 4. A central carrier unit 10 (FIG. 1) is connected to roof struts 30 (FIG. 2) which are spaced by peripheral roof members 50 (FIG. 3) and supported by side wall members 70 (FIG. 4) and a flexible covering 100 completes the tent which is of regular hexagonal plan in this embodiment.

Figure 1:
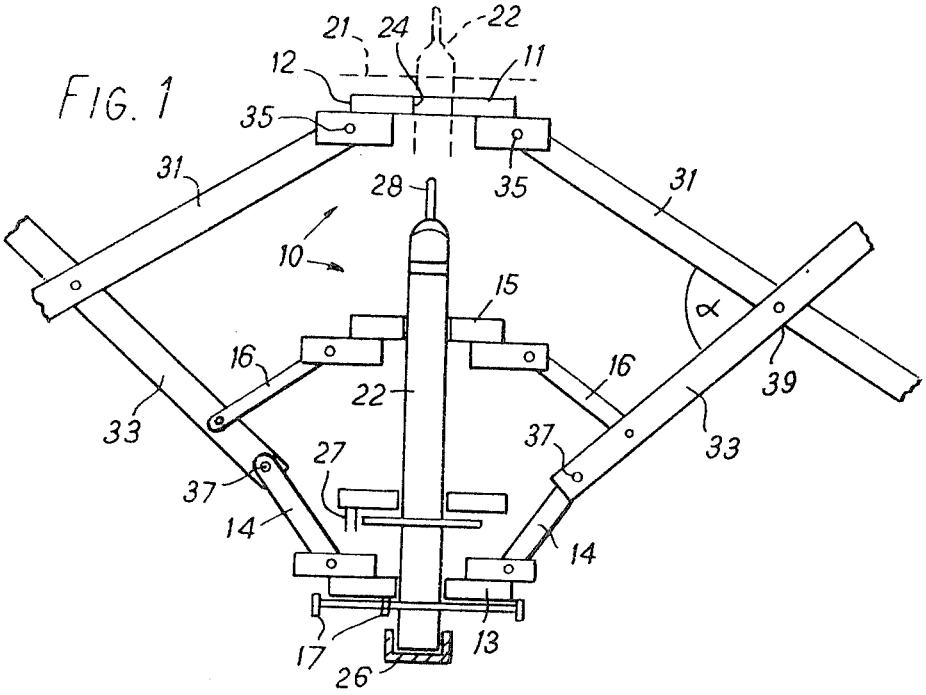
FIG. 1 shows an elevational section of a central carrier unit of a tent roof structure.

Turning to FIG. 1, the central carrier unit 10 of a tent roof structure carries a plurality of collapsible roof struts 30. Of the six struts 30 required for the hexagonal plan tent of FIG. 7 only one strut is seen in the elevation of FIG. 2. Each strut 30 is constructed with a first articulated member 31 and a second articulated member 33. First and second articulated members 31,33 are pivotally connected at pivots 35,37 to first and second central carrier members 11 and 13 respectively. First and second central carrier members 11,13 are arranged for relative displacement towards each other to a first position in which said first and second central carrier members 11,13 are axially aligned by axial coupling means 22. In the first position the collapsible roof struts 30 extend outwardly from said first and second central carrier members 11,13. The displacement from the first erect position is to a second collapsed position in which first and second central carrier members 11,13 are axially displaced from one another to enable struts 90 to adopt a folded attitude in which the first and second articulated members 31,33 extend substantially axially of the first and second carrier members 11,13.

The first central carrier member 11 comprises a plate-like member 12 (FIGS. 5,6) having a central aperture 24 and a plurality of angularly spaced compartments 26. Each compartment 26 defines first and second abutments 27,28 to limit the movement of an associated articulated member 31 beyond the position it occupies said first and second roof positions. The configuration of member 12 is more readily apparent from FIGS. 5 and 6 in which a member to be moulded in plastics material as shown.

Figure 5:
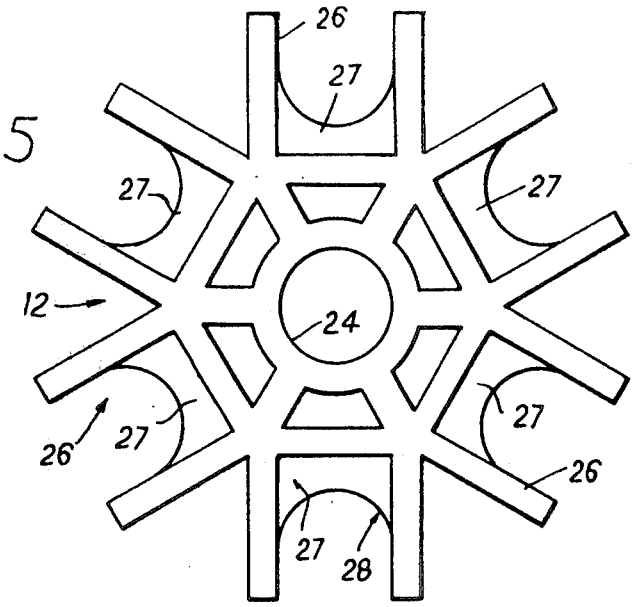
FIG. 5 shows a plan view of a carrier member of the central carrier unit.

The second central carrier member 13 also comprises a plate-like member 12 as shown in FIG. 5.

In addition the second central carrier member 13 also co-operates with an additional plate-like member 15 again as shown in FIG. 5.

In consequence each second articulated member 33 is linked by a first link 14 to the plate-like member 12 of the second central carrier 13 and a second link 16 to the further plate-like member 15. The first and second links 14,16 assist in maintaining rotational stability of the struts 30 about the central carrier members 11,13,15.

The axial coupling means is provided by an elongate member 22 fixedly connected by a nut and bolt fastening 17 relative to the carrier member 13. Member 22 is aligned with the central aperture 24 of the plate-like members 12. The elongate member 22 in the first erect position of the roof structure extends through the apertures 24 in plate-like members 12 of the other carrier members 15,11. It is retained by releasable fastening means 21 shown in chain dotted lines in FIG. 1 in the position occupied by elongate member 22 when the roof structure is in said erect position. The articulated member 31 is pivotally linked at 52 to a peripheral roof member 50 (FIG. 3). The peripheral roof member 50 is articulated at an intermediate portion 51 thereof to fold in response to folding of the respective strut 30. Also peripheral roof member 50 is pivotally connected to another peripheral roof member 50. Each member 50 comprises two parts 53,54.

In FIG. 3, the additional tube member 58 is inserted, such that member 53 is sandwiched between members 50 and 55 and member 41 is also sandwiched between members 50 and 55. The position of the cross-over of members 50,41 is such that pin 52 (which extends through both members 50,55) is also parallel to pin 55.

When the central carrier unit 10 occupies its first position the struts 30 spread outwardly therefrom and depend to below the level of the carrier member 12 such that peripheral roof members 50 are below this level. In consequence the covering 100 (FIG. 7) on the roof structure has the pyramid configuration necessary to a tent structure. This is achieved because the links 14,16 allow member 33 to pass through the horizontal, as viewed in FIG. 1 such that member 33 depends outwardly and downwardly. For assisting in the folding action of the frame, the pivot axis 55 of the connection between the peripheral member 50 and the strut 30 is aligned with the direction of axial movement of coupling member 22. The pivotal axis 57 of the articulated connection at the intermediate portion between parts 54,53 of the peripheral roof member 50 is inclined inwardly (of the roof structure in its first position) relative to pivotal axis 55.

In the described embodiment, an angle of inclination between said pivotal axes 55,57 of 30° facilitates the folding of said peripheral members 50 simultaneously with the folding of said strut 30. The outer end 41 of the articulated member 31 connected to the peripheral members 50 is arcuate to facilitate the connection thereto of a side wall member 70 (FIG. 4). A side wall member 70 is connected at the junction of each strut 30 and peripheral roof member 50 by means of being pivotally connected to the roof strut 30.

Turning to FIG. 4, each side wall member 70 comprises first and second articulated wall struts 71,73. The first wall strut 71 has a first part 74 adapted at one end 72 for rigid connection by insertion to the end 41 of articulated member 31 and a second part 76 pivotally connected at 75 to the second wall strut 73. The second wall strut 73 has a first part 77 coupled by pivotal connection 80 to the end 41 of the same articulated member 31 of the same roof strut 30 (FIGS. 2 and 4). A link 79 is pivotally connected with the outer part 41 of said one articulated member 31 at 78 and the pivotal connection 80.

The articulated ends 81,82 of the first and second parts 77,87 of the second wall strut 73 are arcuate and provide stops 83,84 to abut first and second parts 74,76 of the first wall strut 71. The stops 83,84 ensure that with the roof structure in its erect position the side wall member is stabilized with respect of outward movement of the articulation 85 of the wall strut 71.

In the erect position of the roof structure with the axial coupling means 22 securing the carrier members 11,13 in their first position, the angle $\alpha$ (FIGS. 1 and 2) subtended by the articulated members 31,33, when these are fully extended and generally parallel to one another, is at its minimum in the collapsed position of the roof structure with the axial coupling means 22 disconnected so that the carrier members 11,13 are at their maximum spacing, the angle $\alpha$ (FIGS. 1 and 2) is at its maximum and substantially 180° whereby the members 31,33 are each folded about their intermediate pivot points 47,49 and the parts 41,31 and 43,33 of each member 31,33 all lie substantially parallel to the elongate member 22. On the folding action taking place, peripheral roof member 50 is folded about pivot 57 (clip 56 being released). The individual parts 53,54 pivot inwardly about pivots 55,52. This results in the folded roof member 50 also occupying an attitude substantially parallel to member 22. Prior to folding of the roof structure, the side wall members 70 are folded up about pivot 80 after end 72 is manually released. After end 72 is released each member 71,73 is folded about the pivots 85,91 such that parts 74,76 and 77,87 of these members lie parallel to member 41. Means such as tape (not shown) is provided for securing the members 71,73 and 41, together in this collapsed or folded condition for transit. An end piece 92 on link 79 enables advantageous positioning of these members in the folded condition, with end piece 92 behind the adjacent member 41 and placed towards the end 41 thereof. Each lower member 87 of wall members 70 carries a foot 93.

In this embodiment the members are generally tubular rods drilled to provide apertures for bolts secured to constitute pivots. The end stops, feet and carrier members 12 are moulded from suitable plastics materials.

It will be readily appreciated that whilst each member 12 has been referred to as "plate-like member", there is no intention to limit the geometric configuration of the member 12 by a narrow construction of this term: the essential characteristics of the member 12 will be readily apparent from the relationship defined therefor in the appended claims.

It will also be readily apparent that the members and links are not essentially tubular. The connection between the end 72 of side wall member 70 and the end 41 of roof strut 30 is conveniently a push-fit connection between tubular members. Nevertheless, a tubular fitting may be attached to non-tubular members 41,71 or a different form of releasable connection made, e.g. as for member 22 in FIG. 1.

In FIG. 1 elongate member 22 is provided with an end cap 26 of plastics material as a foot therefor and a spigot 28 to extend through an appropriate ferrule (not shown) in the tent covering 100 (FIG. 7). Disc 27 (with an associated fastening therefor) may be provided to limit the movement of links 14 towards member 22.

In FIG. 2 articulated members 31,33 are foldable about pivot points 47,49 which link their separate parts 31,41 and 33,43 respectively. It is envisaged that strut 30 may be modified by the elimination of the strut parts 41,43 with an arcuate end on the strut part 31. The term "strut member" has been used in order to embrace both constructions.

In the above description reference is made to an optimum of 30° for the angle of inclination of pivot axis 57 relative to pivot axis 55 as described with reference to FIG. 3. It is found whilst this angle of 30° facilitates folding of peripheral member 50 in a hexagonal roof structure different optimum angles between these pivot axes are necessary for other roof shapes. With a rectangular shaped roof, this angle is modified to 45°.

Other modifications may be made within the scope of the appended claims.

Figure 6:
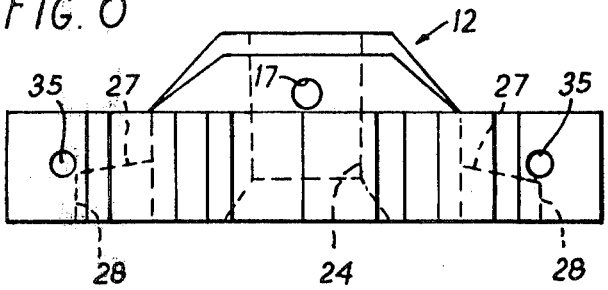
FIG. 6 shows a sectional elevation on the carrier member of FIG. 5.

A point of further explanation concerning FIG. 6 is as follows. The first and second abutments 27,28 are so arranged that after the articulated member 31 reaches a position corresponding to one of the first and second positions of the carrier members 12 if the movement of that articulated member 31 continues then the member 31 abuts the respective one of the abutments 27,28 i.e. the abutments 27,28 limit the degree of movement of the member 31 beyond the position it occupies in the first and second roof positions.

What is claimed is:

1. A tent roof structure comprising a plurality of collapsible roof struts, each strut having a first strut member and a second strut member, first and second central carrier members, said first and second strut members being pivotally connected to a respective one of said first and second central carrier members, said first and second central carrier members being arranged for relative displacement towards each other, and axial coupling means to align axially said first and second central carrier members in a first position and in which first position the collapsible roof struts extend outwardly from said first and second central carrier members, in a second position thereof said first and second central carrier members are axially displaced from one another to enable said struts to adopt a folded attitude in which the first and second strut members extend substantially axially of the first and second carrier members, wherein each of the first and second central carrier members comprises a plate-like member, a central aperture in each plate-like member, a plurality of angularly spaced compartments on each plate-like member, first and second abutments on each compartment to limit the movement of a respective first strut member beyond the position occupied by that member in said first and second positions of the carrier members, and wherein the second central carrier member further comprises a further plate-like member, a central aperture in said further plate-like member, a plurality of angularly spaced compartments in said further plate-like member, first and second abutments on said further plate-like member to limit the movement of a respective second strut member beyond the position occupied by that member in said first and second positions of the carrier members, wherein a first link connects each second strut member to the plate-like member of the second central carrier and a second link connects each second strut member to the further plate-like member of the second central carrier, whereby said first and second links assist in maintaining rotational stability of the struts about the central carrier members.

2. A tent frame structure as defined in claim 1, wherein the first and second strut members are articulated members foldable about pivot joints intermediate their longitudinal dimension.

3. A tent roof structure as defined in claim 1, comprising an elongate member providing the axial coupling means, said elongate member being connected to one of said first and second central carrier members and aligned with the central aperture of the plate-like members thereof, said elongate member in said first position extending through the plate-like member or members of the other of said first and second central carrier members and being retained by releasable fastening means.

4. A tent roof structure comprising a plurality of collapsible roof struts each strut having a first strut member and a second strut member, first and second central carrier members, said first and second strut members being pivotally connected to a respective one of said first and second central carrier members, said first and second central carrier members being arranged for relative displacement towards each other, and axial coupling means to align axially said first and second central carrier members in a first position and in which first position the collapsible roof struts extend outwardly from said first and second central carrier members, in a second position thereof said first and second central carrier members are axially displaced from one another to enable said struts to adopt a folded attitude in which the first and second strut members extend substantially axially of the first and second carrier members, wherein each of the first and second central carrier members comprises a plate-like member, a central aperture in each plate-like member, a plurality of angularly spaced compartments on each plate-like member, first and second abutments on each compartment to limit the movement of a respective first strut member beyond the position occupied by that member in said first and second positions of the carrier members, and wherein the second central carrier member further comprises a further plate-like member, a central aperture in said further plate-like member, a plurality of angularly spaced compartments in said further plate-like member, first and second abutments on said further plate-like member to limit the movement of a respective second strut member beyond the position occupied by that member in said first and second positions of the carrier members, wherein a first link connects each second strut member to the plate-like member of the second central carrier and a second link connects each second strut member to the further plate-like member of the second central carrier, whereby said first and second links assist in maintaining rotational stability of the struts about the central carrier members, and wherein a peripheral roof member is pivotally linked to one of said first and second strut members, said peripheral roof member being articulated at an intermediate portion thereof to fold in response to folding of the respective strut, said peripheral roof member also being pivotally connected to another peripheral roof member.

5. A tent roof structure as defined in claim 4, wherein the pivot axis of the connection betwene the peripheral member and the strut is aligned with the direction of axial movement of said coupling means, the pivotal axis of the articulated connection at the intermediate portion of the peripheral roof member being inclined inwardly of the roof structure in its first position relative to said first mentioned pivotal axis.

6. A tent roof structure as defined in claim 4, wherein in an hexagonal roof structure an angle of inclination between said pivotal axes of 30° facilitates the folding of said peripheral members simultaneously with the folding of said struts.

7. A tent roof structure as defined in claim 4, wherein a side wall member is pivotally connected at the junction of each strut and peripheral roof member, each side wall member comprising first and second articulated wall struts, a first part of the wall strut being adapted at one end for rigid connection to the end of a respective said one strut member and a second part of the first wall strut being pivotally connected to the second wall strut, a first part of the second wall strut being coupled by pivotal connection to the same roof strut, a link being pivotally connected between said one strut member and the pivotal connection.

8. A tent roof structure as defined in claim 7, wherein the articulated ends of the first and second parts of the second wall strut are arcuate, said arcuate ends providing stops to abut first and second parts of the first wall strut whereby, in the erect second position of the roof structure with the side wall members also erect, the side wall member is stabilized with respect to outward movement of the articulation of the second wall strut.

* * * * *